US011004399B2

(12) United States Patent
Park et al.

(10) Patent No.: US 11,004,399 B2
(45) Date of Patent: May 11, 2021

(54) DISPLAY APPARATUS AND DRIVING METHOD THEREOF

(71) Applicant: LG DISPLAY CO., LTD., Seoul (KR)

(72) Inventors: Kyeongtae Park, Paju-si (KR); Subin Park, Paju-si (KR); Kyeongtae Min, Paju-si (KR); Sungchang Park, Paju-si (KR); Jongtak Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/687,030

(22) Filed: Nov. 18, 2019

(65) Prior Publication Data

US 2020/0160792 A1 May 21, 2020

(30) Foreign Application Priority Data

Nov. 21, 2018 (KR) ..... 10-2018-0144750

(51) Int. Cl.

| | |
|---|---|
| ***G09G 5/10*** | (2006.01) |
| ***G09G 3/3275*** | (2016.01) |
| ***G09G 3/3266*** | (2016.01) |
| ***G09G 3/36*** | (2006.01) |

(52) U.S. Cl.

CPC ..... *G09G 3/3275* (2013.01); *G09G 3/3266* (2013.01); *G09G 3/3677* (2013.01); *G09G 3/3688* (2013.01); *G09G 2310/027* (2013.01); *G09G 2310/08* (2013.01); *G09G 2320/0233* (2013.01); *G09G 2320/0242* (2013.01); *G09G 2320/0271* (2013.01)

(58) Field of Classification Search

CPC .. G09G 3/3275; G09G 3/2003; G09G 3/3406; G09G 3/3266; G09G 3/3677; G09G 3/3688; G09G 2310/027; G09G 2310/08; G09G 2320/0233; G09G 2320/0673; G09G 2320/0242; G09G 2320/0271

USPC ..... 345/691, 693, 100

See application file for complete search history.

(56) References Cited

U.S. PATENT DOCUMENTS

| | | | | |
|---|---|---|---|---|
| 2011/0057917 | A1* | 3/2011 | Ryu | G09G 3/3266 345/211 |
| 2016/0104408 | A1* | 4/2016 | Kim | G09G 3/36 345/690 |
| 2016/0321983 | A1* | 11/2016 | Kim | H01L 27/3276 |

FOREIGN PATENT DOCUMENTS

| | | | |
|---|---|---|---|
| KR | 10-2012-0070921 | A | 7/2012 |
| KR | 10-2013-0018493 | A | 2/2013 |
| KR | 10-2017-0078051 | A | 7/2017 |

* cited by examiner

*Primary Examiner* — Jennifer T Nguyen

(74) *Attorney, Agent, or Firm* — Birch, Stewart, Kolasch & Birch, LLP

(57) ABSTRACT

A display apparatus can include a display panel configured to display images; a scan driver configured to supply scan signals to the display panel; a data driver configured to supply data voltages to the display panel; a timing controller configured to control the scan driver and the data driver; and a device controller configured to in response to receiving a frequency change signal, change a driving frequency of a device from a first frequency to a second frequency higher than the first frequency or change the driving frequency of the device from the second frequency to the first frequency, while maintaining widths of driving signals of the scan driver before and after the driving frequency is changed, in which the device includes at least one of the scan driver or the data driver.

21 Claims, 14 Drawing Sheets

(a)

(b)

DISPLAY APPARATUS AND DRIVING METHOD THEREOF

This application claims the priority benefit of Korean Patent Application No. 10-2018-0144750, filed in the Republic of Korea on Nov. 21, 2018, which is incorporated herein by reference for all purposes as if fully set forth herein.

BACKGROUND OF THE DISCLOSURE

Field of the Disclosure

The present disclosure relates to a display apparatus and a driving method thereof.

Related Art

With the development of information technology, markets of display apparatuses which are connection media between users and information are growing. Accordingly, display apparatuses, such as a light emitting display (LED) apparatus, a quantum dot display (QDD) apparatus and a liquid crystal display (LCD) apparatus, are increasingly used.

The aforementioned display apparatuses include a display panel having sub-pixels, drivers which output driving signals for driving the display panel, a power supply which generates power to be provided to the display panel or the drivers, and the like.

The aforementioned display apparatuses can display images in such a manner that selected sub-pixels transmit light or directly emit light when driving signals, for example, scan signals and data signals, are provided to sub-pixels formed in the display panel.

Some of the above-described display apparatuses have many advantages, such as electrical and optical properties of a high response speed, high luminance and a wide viewing angle and mechanical properties of a flexible form. However, there is a problem of deterioration of display quality or operation reliability when a driving frequency of a display panel is changed.

SUMMARY OF THE DISCLOSURE

A display apparatus according to an embodiment of the present disclosure includes a display panel displaying images; a scan driver providing scan signals to the display panel; a data driver providing data voltages to the display panel; a timing controller controlling the scan driver and the data driver; and a device controller changing a driving frequency of a device including the scan driver and the data driver to a first frequency or a second frequency higher than the first frequency in response to a frequency change signal, and the device controller maintains the widths of driving signals of the scan driver before and after the driving frequency of the device is changed.

A display apparatus according to an embodiment of the present disclosure includes: a display panel displaying images; and a device controller changing a driving frequency of a device to a first frequency or a second frequency higher than the first frequency in response to a frequency change signal, and the device controller maintains the widths of a vertical synchronization signal, a start signal and a clock signal for operation of the device before and after the driving frequency of the device is changed.

A display apparatus according to an embodiment of the present disclosure includes a display panel displaying images; and a device controller changing a driving frequency of a device to a first frequency or a second frequency higher than the first frequency in response to a frequency change signal, and a data voltage applied to the display panel is compensated on the basis of a higher gamma voltage than that during operation at the first frequency when the driving frequency is changed to the second frequency higher than the first frequency.

A display apparatus according to an embodiment of the present disclosure includes a display panel displaying images; and a device controller changing a driving frequency of a device to a first frequency or a second frequency higher than the first frequency in response to a frequency change signal, and the display panel does not have a display off period in which a screen is not displayed when the driving frequency is changed from the first frequency to the second frequency or changed from the second frequency to the first frequency.

A method of driving a display apparatus according to an embodiment of the present disclosure includes driving a device at a first frequency and displaying an image or screen on a display panel; checking whether a signal instructing the first frequency to be changed to a second frequency higher than the first frequency is input; and driving the device at the second frequency and displaying an image or screen on the display panel when the signal instructing the first frequency to be changed to the second frequency is input, wherein the display panel does not have a display off period in which a screen is not displayed when a driving frequency is changed from the first frequency to the second frequency or changed from the second frequency to the first frequency.

BRIEF DESCRIPTION OF THE DRAWINGS

The accompany drawings, which are included to provide a further understanding of the disclosure and are incorporated on and constitute a part of this specification illustrate embodiments of the disclosure and together with the description serve to explain the principles of the disclosure.

DETAILED DESCRIPTION OF THE EMBODIMENTS

Figure 1:
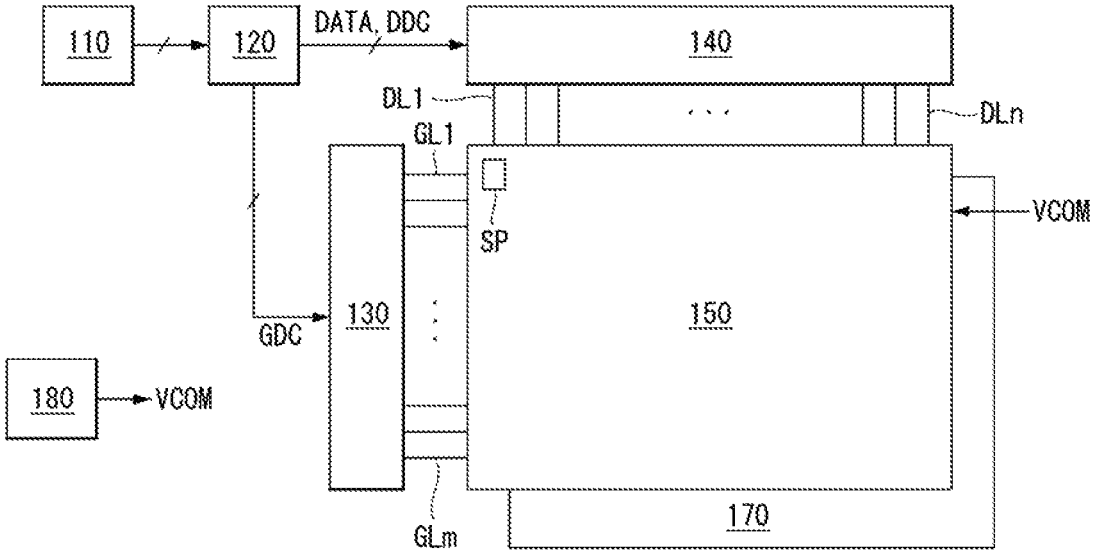
FIG. 1 is a schematic block diagram of a liquid crystal display apparatus according to an embodiment of the present disclosure.

Reference will now be made in detail embodiments of the disclosure examples of which are illustrated in the accompanying drawings.

Hereinafter, specific embodiments of the present disclosure will be described with reference to the attached drawings.

The advantages, features and methods for accomplishing the same of the present disclosure will become more apparent through the following detailed description with respect to the accompanying drawings. However, the present disclosure is not limited by embodiments described blow and is implemented in various different forms, and the embodiments are provided so that this disclosure will be thorough and complete, and will fully convey the scope of the disclosure to those skilled in the art. The present disclosure is defined by the scope of the claims.

Shapes, sizes, ratios, angles, numbers, etc. shown in the figures to describe embodiments of the present disclosure are examples and thus are not limited to particulars shown in the figures. Like numbers refer to like elements throughout the specification. In the following description, if a detailed description of known techniques associated with the present disclosure would unnecessarily obscure the gist of the present disclosure, detailed description thereof will be omitted. It will be further understood that when the terms "include," "have" and "comprise" are used in this specification, other parts may be added unless "only" is used. An element described in the singular form is intended to include a plurality of elements unless context clearly indicates otherwise.

In interpretation of a component, the component is interpreted as including an error range unless otherwise explicitly described.

In the description of the various embodiments of the present disclosure, when describing positional relationships, for example, when the positional relationship between two parts is described using "on," "above," "below," "aside," or the like, one or more other parts may be located between the two parts unless the term "directly" or "closely" is used.

It will be understood that, when an element is referred to as being "on" another element, it can be "directly" on another element or can be "indirectly" formed such that an intervening element is also present.

In the following description of the embodiments, "first" and "second" are used to describe various components, but such components are not limited by these terms. The terms are used to discriminate one component from another component. Accordingly, a first component mentioned in the following description may be a second component within the technical spirit of the present disclosure.

The same reference numbers refer to the same components throughout this specification.

The area and thickness of each component in the figures are illustrated for convenience of description and the present disclosure is not limited to the areas and thicknesses of the illustrated components.

Features of embodiments of the present disclosure can be coupled or combined partially or overall and technically interoperated in various manners, and the embodiments may be implemented independently or associatively.

Hereinafter, the present disclosure will be described with reference to the drawings.

A display apparatus according to embodiments of the present disclosure can be implemented as a TV, a video player, a personal computer (PC), a home theater, a vehicle electrical device, a smartphone, and the like, but the present disclosure is not limited thereto. The display apparatus according to embodiments of the present disclosure can be implemented as a light emitting display (LED) apparatus, a quantum dot display (QDD) apparatus, a liquid crystal display (LCD) apparatus, and the like. A light emitting display apparatus which displays images in a manner of directly emitting light can be implemented on the basis of an inorganic light emitting diode or an organic light emitting diode. A light emitting display apparatus implemented on the basis of an organic light emitting diode and a liquid crystal display apparatus will be described as an example in the following description.

Figure 2:
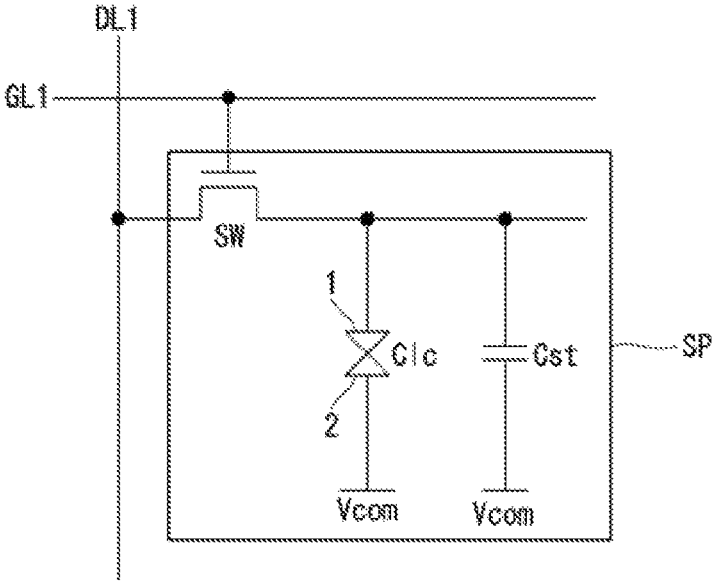
FIG. 2 is a schematic circuit diagram showing a sub-pixel shown in FIG. 1 according to an embodiment of the present disclosure.

FIG. 1 is a schematic block diagram of a liquid crystal display apparatus according to an embodiment of the present disclosure, and FIG. 2 is a schematic circuit diagram showing a sub-pixel shown in FIG. 1.

As shown in FIGS. 1 and 2, the liquid crystal display apparatus includes an image provider 110, a timing controller 120, a scan driver 130, a data driver 140, a liquid crystal panel 150, a back light unit 170, and a power supply 180.

The image provider 110 (or a host system) outputs various driving signals in addition to external image data signals or image data signals stored in an internal memory. The image provider 110 provides data signals and various driving signals to the timing controller 120.

The timing controller 120 outputs a gate timing control signal GDC for controlling operation timing of the scan driver 130, a data timing control signal DDC for controlling operation timing of the data driver 140, and various synchronization signals (vertical synchronization signal Vsync and horizontal synchronization signal Hsync). The timing controller 120 provides a data signal DATA supplied from the image provider 110 along with the data timing control signal DDC to the data driver 140. The timing controller 120 can be configured in the form of an integrated circuit (IC) and mounted on a printed circuit board, but the present disclosure is not limited thereto.

The scan driver 130 outputs scan signals (or scan voltages) in response to the gate timing control signal GDC supplied from the timing controller 120. The scan driver 130 provides the scan signals to sub-pixels included in the liquid crystal panel 150 through scan lines GL1 to GLm. The scan driver 130 can be configured in the form of an IC or directly formed on the liquid crystal panel 150 in a gate-in-panel (GIP) structure, but the present disclosure is not limited thereto.

The data driver 140 samples and latches data signals DATA in response to the data timing control signal DDC supplied from the timing controller 120, converts digital data signals into analog data signals on the basis of a gamma reference voltage and outputs the analog data signals. The data driver 140 provides data voltages to sub-pixels included in the liquid crystal panel 150 through data lines DL1 to DLn. The data driver 140 can be configured in the form of an IC and mounted on the liquid crystal panel 150 or mounted on a printed circuit board, but the present disclosure is not limited thereto.

The power supply 180 generates a common voltage VCOM on the basis of an external input voltage supplied from the outside and outputs the common voltage VCOM. The power supply 180 can generate and output voltages (e.g., a scan high voltage and a scan low voltage) for operation of the scan driver 130, voltages (a drain voltage and a half drain voltage) for operation of the data driver 140, and the like as well as the common voltage VCOM.

The liquid crystal panel 150 displays an image in response to scan signals supplied from the scan driver 130, data voltages supplied from the data driver 140, and the common voltage VCOM supplied from the power supply 180. Sub-pixels of the liquid crystal panel 150 control light provided through the back light unit 170.

For example, one sub-pixel SP includes a switching transistor SW, a storage capacitor Cst, and a liquid crystal layer Clc. The gate electrode of the switching transistor SW is connected to the scan line GL1 and the source electrode thereof is connected to the data line DL1. One terminal of the storage capacitor Cst is connected to the drain electrode of the switching transistor SW and the other terminal thereof is connected to a common voltage line Vcom. The liquid crystal layer Clc is formed between a pixel electrode 1 connected to the drain electrode of the switching transistor SW and a common electrode 2 connected to the common voltage line Vcom.

The liquid crystal panel 150 is implemented in a twisted nematic (TN) mode, a vertical alignment (VA) mode, an in-plane switching (IPS) mode, a fringe field switching (FFS) mode, an electrically controlled birefringence (ECB) mode, or the like according to the structures of the pixel electrode 1 and the common electrode 2.

The back light unit 170 provides light to the liquid crystal panel 150 using a light source that emits light. The back light unit 170 can include light-emitting diodes (LEDs), an LED driver for driving the LEDs, an LED substrate on which the LEDs are mounted, a light guide for converting light emitted from the LEDs into plane light, a reflector for reflecting light under the light guide, optical sheets for focusing and spreading light emitted from the light guide, and the like, but the present disclosure is not limited thereto.

Figure 3:
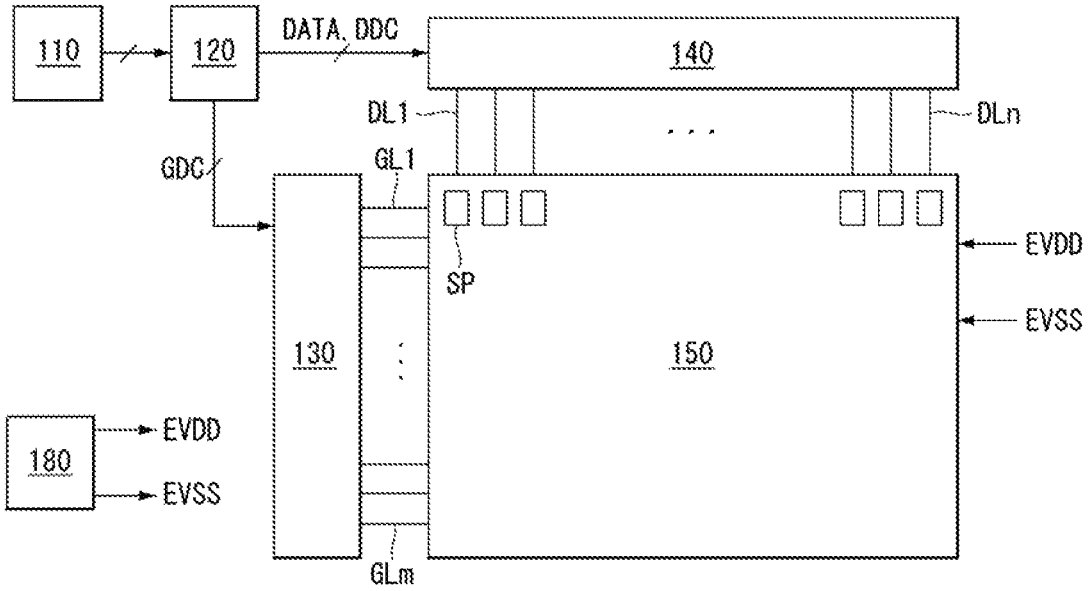
FIG. 3 is a schematic block diagram of an organic electroluminescent display apparatus according to an embodiment of the present disclosure.
Figure 4:
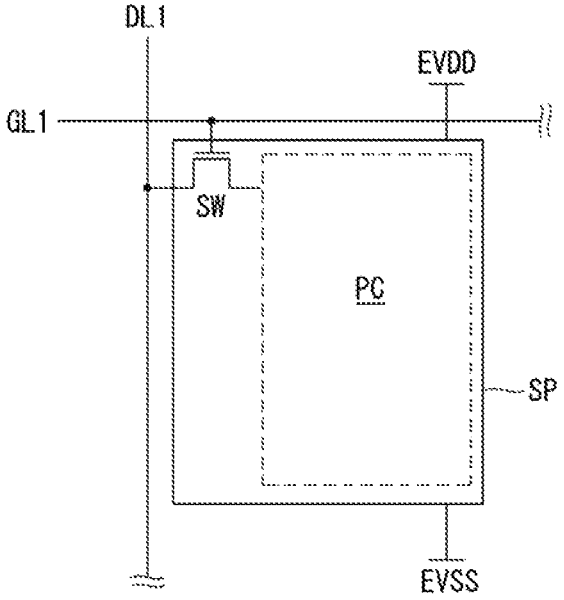
FIG. 4 is a schematic diagram showing a configuration of the sub-pixel shown in FIG. 3 according to an embodiment of the present disclosure.

FIG. 3 is a schematic block diagram of an organic electroluminescent display apparatus according to an embodiment of the present disclosure and FIG. 4 is a schematic diagram showing a configuration of the sub-pixel shown in FIG. 3.

As shown in FIGS. 3 and 4, the organic electroluminescent display apparatus includes an image provider 110, a timing controller 120, a scan driver 130, a data driver 140, a display panel 150, and a power supply 170.

The basic configurations and operations of the image provider 110, the timing controller 120, the scan driver 130 and the data driver 140 included in the organic electroluminescent display apparatus are similar to those of the liquid crystal display apparatus of FIG. 1 and thus detailed description thereof is omitted. The power supply 180 and the display panel 150 distinguished from those of the liquid crystal display apparatus will be described in more detail.

The power supply 180 generates a first power voltage EVDD that is a high voltage and a second power voltage EVSS that is a low voltage on the basis of an external input voltage supplied from the outside and outputs the first power voltage EVDD and the second power voltage EVSS. The power supply 180 can generate and output voltages (e.g., a scan high voltage and a scan low voltage) for operation of the scan driver 130, voltages (a drain voltage and a half drain voltage) for operation of the data driver 140, and the like as well as the first and second power voltages EVDD and EVSS.

The display panel 150 displays an image in response to driving signals including scan signals and data voltages output from drivers including the scan driver 130 and the data driver 140 and the first and second power voltages EVDD and EVSS output from the power supply 180. Sub-pixels of the display panel 150 directly emit light. The display panel 150 may be manufactured based on a rigid or flexible substrate such as a glass, silicon or polyimide substrate. In addition, sub-pixels which emit light can include red, green and blue sub-pixels or red, green blue and white sub-pixels.

For example, one sub-pixel SP includes a pixel circuit PC including a switching transistor SW, a driving transistor, a storage capacitor, and an organic LED. Sub-pixels SP used in the organic electroluminescent display apparatus directly emit light and thus a circuit configuration is complicated compared to the liquid crystal display apparatus. Further, not only the organic LED emitting light but also a compensation circuit for compensating for deterioration of a driving transistor that provides a driving current to the organic LED have complicated and various configurations. Accordingly, the pixel circuit PC included in the sub-pixel SP is illustrated in the form of a block.

The timing controller 120, the scan driver 130 and the data driver 140 described in FIGS. 1 and 3 can be defined as a panel driver for driving the display panel 150. The panel driver can be implemented in the form of an IC including all of the timing controller 120, the scan driver 130 and the data driver 140. However, this corresponds to a situation in which a small-sized or medium-size display apparatus is implemented. When a large-sized display apparatus is implemented, the timing controller 120, the scan driver 130 and the data driver 140 are configured as respective ICs.

Figure 5:
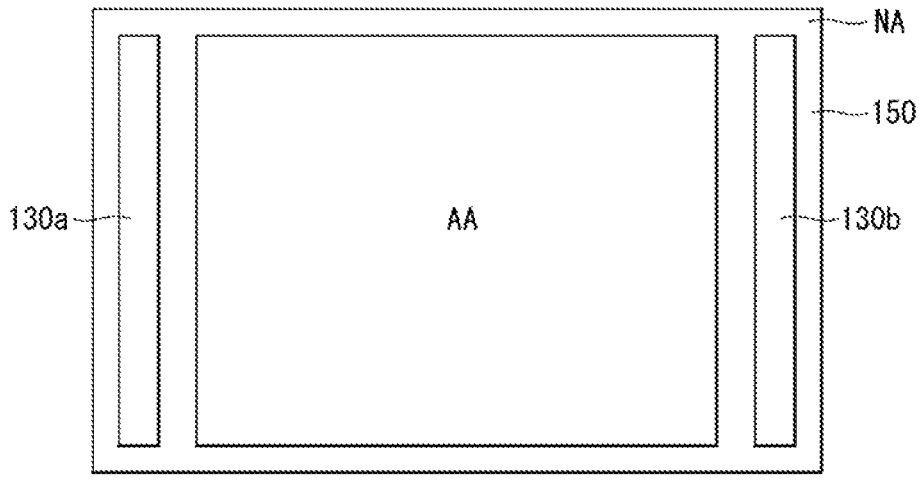
FIG. 5 is a diagram showing examples of an arrangement of a scan driver in a gate-in-panel structure according to embodiments of the present disclosure.
Figure 5:
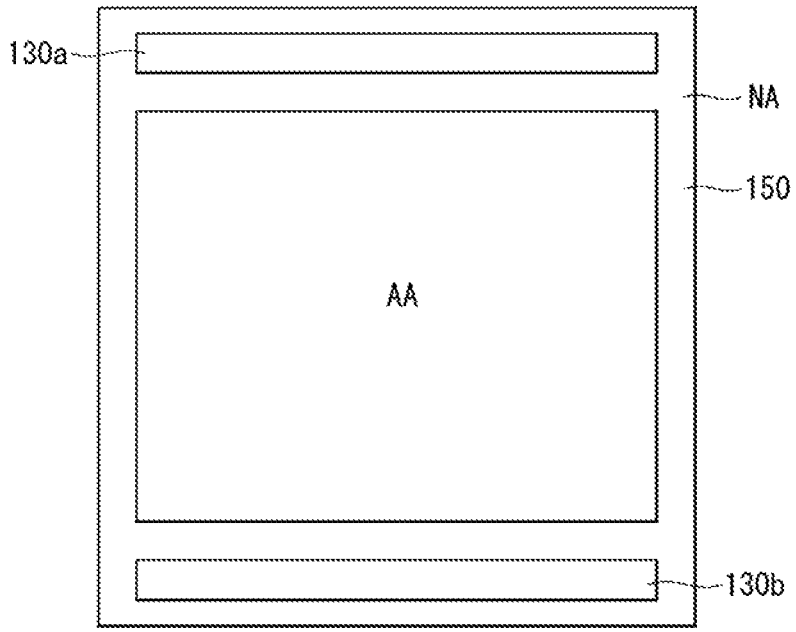
Figure 6:
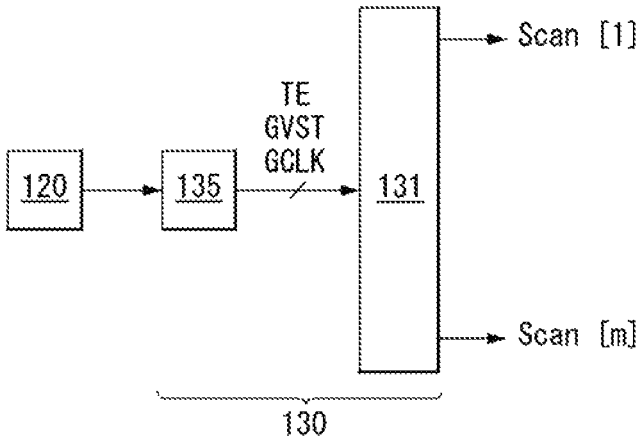
FIG. 6 is a diagram illustrating a configuration of a device associated with a scan driver in a gate-in-panel structure according to an embodiment of the present disclosure.
Figure 7:
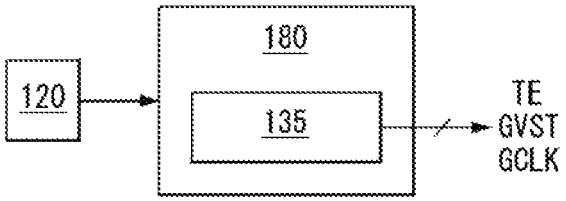
FIG. 7 is a diagram illustrating a configuration of a device associated with a scan driver in a gate-in-panel structure according to another embodiment of the present disclosure.
Figure 8:
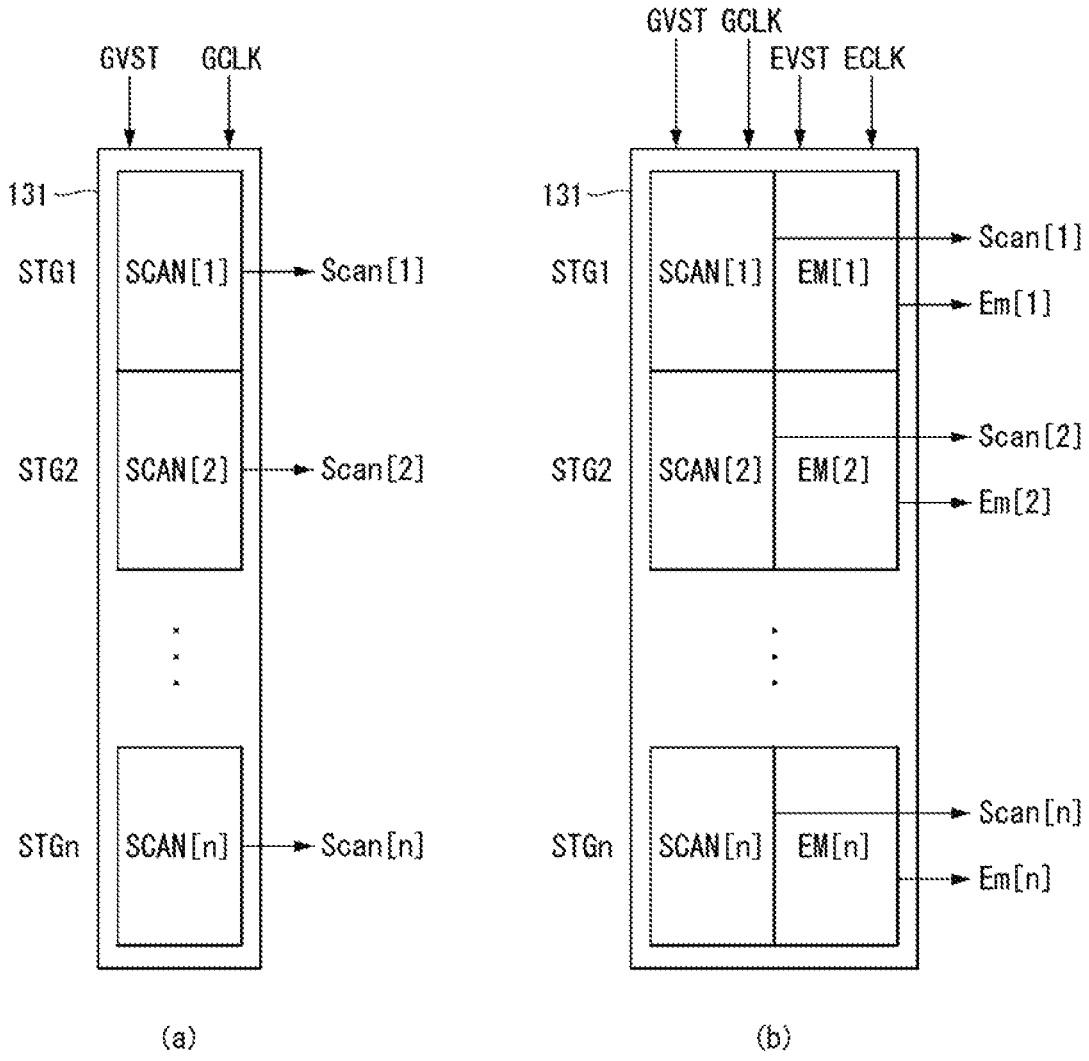
FIG. 8 is a diagram illustrating a configuration of a shift register according to an embodiment of the present disclosure.

FIG. 5 is a diagram showing examples of arrangement of a scan driver (e.g., gate driver) in a gate-in-panel (GIP) structure according to an embodiment of the present disclosure, FIG. 6 is a diagram illustrating a first configuration of a device associated with the scan driver in the gate-in-panel structure, FIG. 7 is a diagram illustrating a second configuration of a device associated with the scan driver in the gate-in-panel structure, and FIG. 8 is a diagram illustrating a configuration of a shift register.

As shown in FIG. 5, scan drivers 130*a* and 130*b* in a gate-in-panel structure are disposed in a non-display area NA of the display panel 150. The scan drivers 130*a* and 130*b* can be disposed in left and right non-display areas NA of the display panel 150, as shown in FIG. 5(*a*). Further, the scan drivers 130*a* and 130*b* can be disposed in upper and lower non-display areas NA of the display panel 150, as shown in FIG. 5(*b*).

Although an example in which the scan drivers 130*a* and 130*b* are disposed as a pair in the non-display areas NAs positioned on the left and right sides or upper and lower sides of a display area AA has been described, the present disclosure is not limited thereto and only one scan driver can be disposed on the left, right, upper or lower side of the display area AA.

As shown in FIG. 6, the scan driver 130 in a gate-in-panel structure can include a shift register 131 and a level shifter 135. The level shifter 135 generates a plurality of clock signals GCLK and ECLK and start signals GVST and EVST on the basis of signals output from the timing controller 120 and outputs the generated signals. The plurality of clock signals GCLK and ECLK can be generated and output as K (K is an integer equal to or greater than 2) different phases such as 2 phases, 4 phases and 8 phases.

The clock signals GCLK and ECLK are driving signals that alternate between logic high and logic low having a predetermined cycle in order to control operation and output of a device included in the shift register 131 and the start signals GVST and EVST are driving signals that generate logic high or logic low once per frame in order to control the start of operation of the shift register 131.

The shift register 131 operates on the basis of the signals GCLK, ECLK, GVST and EVST output from the level shifter 135 and outputs scan signals Scan[1] to Scan[m] for turning on or turning off transistors formed in the display panel. The shift register 131 is formed in the form of a thin film on the display panel in the gate-in-panel structure. That is, a part of the scan driver 130 which is formed on the display panel is the shift register 131 (the parts 130*a* and 130*b* in FIG. 5 correspond to the part 131).

Distinguished from the shift register 131, the level shifter 135 is formed in the form of an IC. Accordingly, the level shifter 135 can be configured in the form of a separate IC, as shown in FIG. 6, or can be included in the power supply 180 or other devices, as shown in FIG. 7.

As shown in FIG. 8, the shift register 131 includes a plurality of stages STG1 to STGn. The plurality of stages STG1 to STGn is connected in a cascade manner and receives an output signal of at least one previous or following stage.

As in the first example shown in FIG. 8(*a*), the stages STG1 to STGn of the shift register 131 can respectively include scan signal generation circuits SCAN[1] to SCAN[n] for outputting scan signals Scan[1] to Scan[n]. For example, the first stage STG1 has the first scan signal generation circuit SCAN[1] as a component for outputting the first scan signal Scan[1]. The scan signal generation circuits SCAN[1] to SCAN[n] can operate on the basis of a first start signal GVST and a first clock signal GCLK.

As in the second example shown in FIG. 8(*b*), the shift register 131 operates on the basis of the first start signal GVST and the first clock signal GCLK. The stages STG1 to STGn of the shift register 131 can respectively include the scan signal generation circuits SCAN[1] to SCAN[n] for outputting the scan signals Scan[1] to Scan[n] and emission signal generation circuits EM[1] to EM[n] for outputting emission signals Em[1] to Em[n]. For example, the first stage STG1 has the first scan signal generation circuit SCAN[1] and the first emission signal generation circuit EM[1] as components for outputting the first scan signal Scan[1] and the first emission signal Em[1]. The scan signal generation circuits SCAN[1] to SCAN[n] can operate on the basis of the first start signal GVST and the first clock signal GCLK and the emission signal generation circuits EM[1] to EM[n] can operate on the basis of a second start signal EVST and a second clock signal ECLK.

According to the examples of FIG. 8, scan signals for driving the display panel can include only the first to n-th scan signals Scan[1] to Scan[n] or additionally include the first to n-th emission signals Em[1] to Em[n]. The first to n-th scan signals Scan[1] to Scan[n] can correspond to signals used when an operation of applying data voltages to sub-pixels is performed and the first to n-th emission signals Em[1] to Em[n] can correspond to signals used when an operation of causing sub-pixels to emit light is performed. However, the examples of FIG. 8 are merely examples for aiding in understanding the configuration of the shift register 131, and the present disclosure is not limited thereto and can be implemented such that a larger number of various signals are output.

Figure 9:
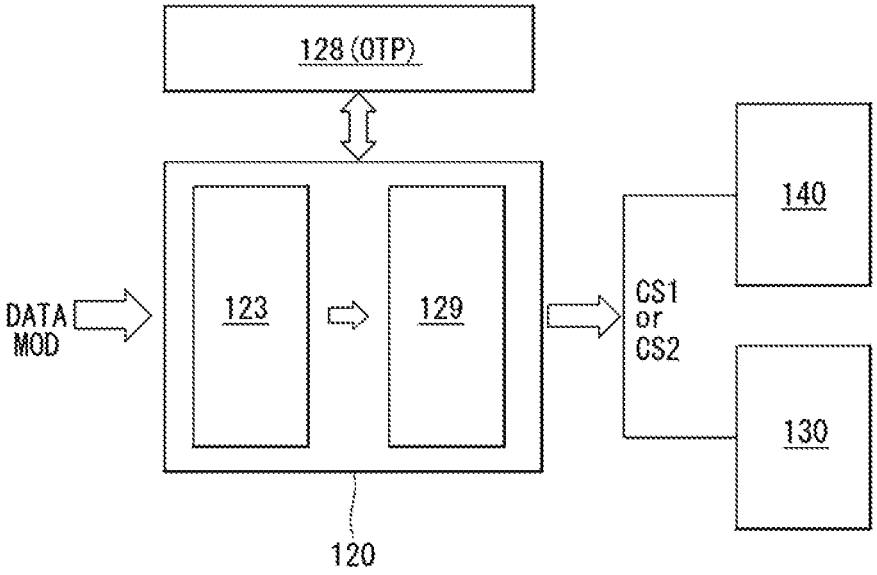
FIG. 9 is an example diagram showing a part of a panel driver according to an embodiment of the present disclosure.
Figure 10:
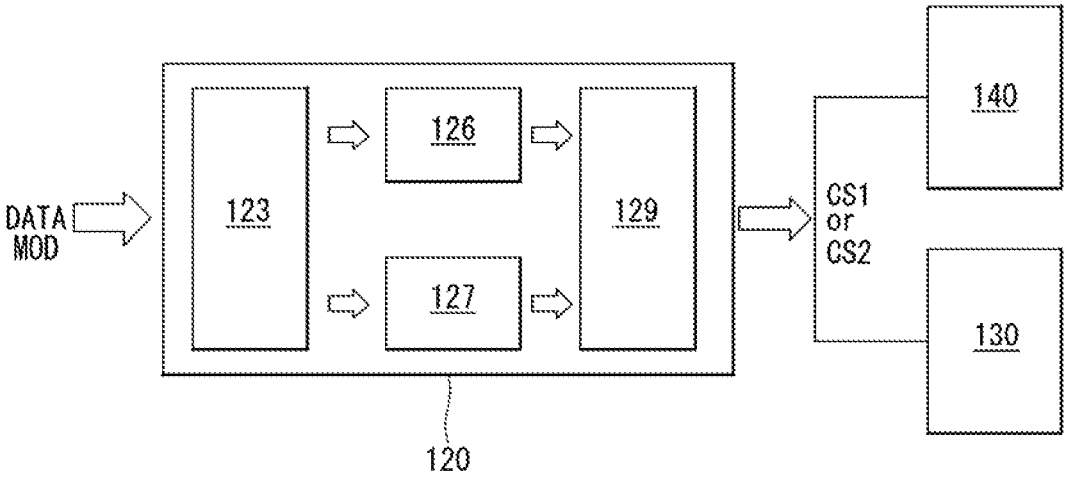
FIG. 10 is another example diagram showing a part of a panel driver according to an embodiment of the present disclosure.
Figure 11:
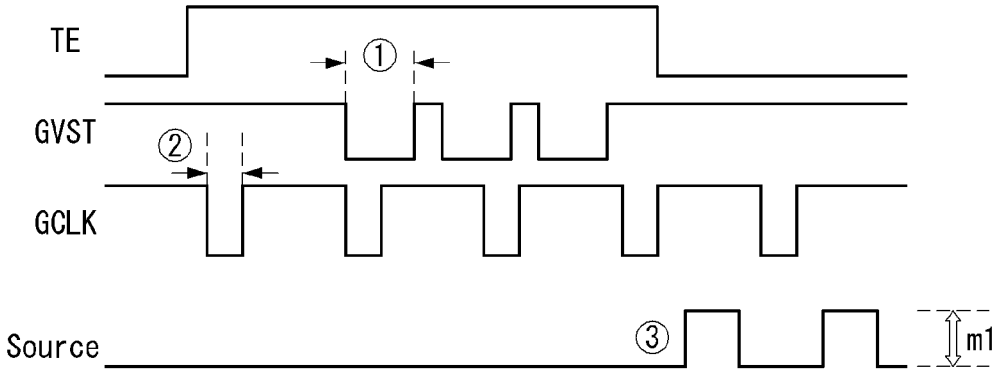
FIG. 11 is a diagram showing waveforms of signals when operation is performed at a first frequency according to an embodiment of the present disclosure.
Figure 12:
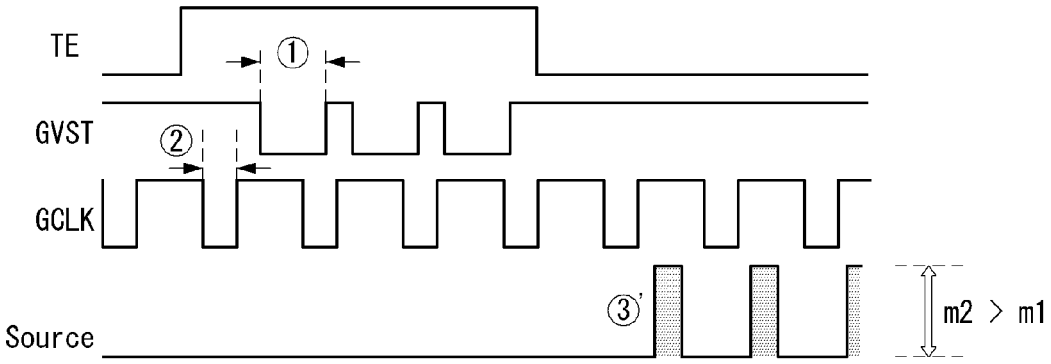
FIG. 12 is a diagram showing waveforms of signals when operation is performed at a second frequency according to an embodiment of the present disclosure.

FIG. 9 is a first example diagram showing a part of a panel driver according to an embodiment of the present disclosure, FIG. 10 is a second example diagram showing a part of a panel driver according to the embodiment of the present disclosure, FIG. 11 is a diagram showing waveforms of signals when operation is performed with a first frequency according to an embodiment of the present disclosure, and FIG. 12 is a diagram showing waveforms of signals when operation is performed with a second frequency according to an embodiment of the present disclosure.

As in the first example shown in FIG. 9, the timing controller 120 according to an embodiment of the present disclosure includes an input signal analysis unit 123 and a control signal output unit 129. The input signal analysis unit 123 and the control signal output unit 129 correspond to a device controller that changes operating conditions of devices, such as the timing controller 120, the scan driver 130 and the data driver 140, when a driving frequency of the display apparatus is changed.

The input signal analysis unit 123 can analyze digital data signals DATA input from the outside and characteristics of a frequency change signal MOD. When the frequency change signal MOD is input, the input signal analysis unit 123 can analyze characteristics of the frequency change signal to determine whether the frequency change signal is a command signal for driving devices at a first frequency or a command signal for driving the devices at a second frequency.

The input signal analysis unit 123 can analyze the frequency change signal MOD, provide a first set value corresponding to the first frequency or a second set value corresponding to the second frequency according to the analysis result, and then transmit the first set value or the second set value to the control signal output unit 129. For example, the input signal analysis unit 123 can analyze the frequency change signal MOD and then retrieve the first set value corresponding to the first frequency or the second set value corresponding to the second frequency from a memory 128 according to the analysis result.

The memory 128 is provided outside the timing controller, for example. However, this is an example and the memory 128 can be provided in the timing controller 120 or other devices. Further, although the memory 128 is configured as a one-time programmable (OTP) memory as an example, the present disclosure is not limited thereto.

The control signal output unit 129 can output a first control signal CS1 in response to the first set value transmitted from the input signal analysis unit 123 or output a second control signal CS2 in response to the second set value. Not only operating conditions of devices, such as the scan driver 130 and the data driver 140, but also operating conditions of devices included in the timing controller 120 can be changed according to the first control signal CS1 and the second control signal CS2 output from the control signal output unit 129.

As in the second example shown in FIG. 10, the timing controller 120 according to an embodiment of the present disclosure includes the input signal analysis unit 123, a first set value output unit 126, a second set value output unit 127, and the control signal output unit 129. The input signal analysis unit 123, the first set value output unit 126, the second set value output unit 127, and the control signal output unit 129 correspond to a device controller that changes operating conditions of devices, such as the timing controller 120, the scan driver 130 and the data driver 140, when the driving frequency of the display apparatus is changed.

The input signal analysis unit 123 can analyze digital data signals DATA input from the outside and characteristics of the frequency change signal MOD. When the frequency change signal MOD is input, the input signal analysis unit 123 can analyze characteristics of the frequency change signal to determine whether the frequency change signal is a command signal for driving devices at the first frequency or a command signal for driving the devices at the second frequency.

The input signal analysis unit 123 can analyze the frequency change signal MOD and then activate one of the first set value output unit 126 and the second set value output unit 127 according to the analysis result representing the first frequency or the second frequency. The first set value output unit 126 activated by the input signal analysis unit 123 transmits the first set value corresponding to the first frequency to the control signal output unit 129 and the second set value output unit 127 activated by the input signal analysis unit 123 transmits the second set value corresponding to the second frequency to the control signal output unit 129.

The control signal output unit 129 can output the first control signal CS1 in response to the first set value transmitted from the input signal analysis unit 123 or output the second control signal CS2 in response to the second set value. Operating conditions of devices, such as the scan driver 130 and the data driver 140, as well as devices included in the timing controller 120 can be changed according to the first control signal CS1 and the second control signal CS2 output from the control signal output unit 129.

As can be ascertained through the above-described first and second examples, the timing controller 120 according to an embodiment of the present disclosure can configure a device controller using a memory or using no memory. However, the present disclosure will be described in detail below on the basis of the first example in which a memory is used.

As shown in FIGS. 9, 11 and 12, the display apparatus according to an embodiment of the present disclosure can operate at the first frequency or the second frequency. For example, the display apparatus can operate with waveforms shown in FIG. 11 when the first control signal CS1 is selected according to the frequency change signal MOD and operate with waveforms shown in FIG. 12 when the second control signal CS2 is selected according to the frequency change signal MOD. The second frequency can be higher than the first frequency.

The first control signal CS1 and the second control signal CS2 control the apparatus such that a synchronization signal TE (or vertical synchronization signal), the first start signal GVST and the first clock signal GCLK are generated in identical or similar conditions. When the driving frequency is changed, signal generation points are shifted in proportion to the frequency in the front porch VFP and the back porch VBP of the synchronization signal TE and thus the first start signal GVST and the first clock signal GCLK are also shifted. Timings of the synchronization signal TE, the first start signal GVST and the first clock signal GCLK can be shortened as the driving frequency increases.

However, according to the embodiment of the present disclosure, start points of these signals TE, GVST and GCLK are maintained by the first and second control signals CS1 and CS2 such that they do not change and become identical or similar to previous ones even when the driving frequency is changed. For example, the width of a signal for driving the scan driver 130 is maintained before and after the driving frequency is changed. This can be ascertained from comparison between waveforms at a first point ① and a second point ② in FIGS. 11 and 12.

At the first point ①, the width of the first start signal GVST is set to be identical or similar at the first frequency and the second frequency. At the second point ②, the width of the first clock signal GCLK is set to be identical or similar at the first frequency and the second frequency.

When the driving frequency is changed from the first control signal CS1 to the second control signal CS2, the level of a data voltage Source output from the data driver 140 may be changed from the previous one. This is because optical compensation is performed such that luminance changes in response to driving frequency change.

A voltage compensation method capable of minimizing changes in color coordinates and luminance when a driving frequency is changed can be selected as an optical compensation method. According to the embodiment, the level of the data voltage Source can increase according to optical compensation as can be seen from the relationship of "m2>m1," each of m2 and m1 represents the amplitude. This can be ascertained by comparing waveforms at third points ③ and ③' in FIGS. 11 and 12. However, optical compensation should consider differences between previous data values and current data values, compensation data to compensate for deterioration of elements, and the like and thus is not limited to the illustrated example.

Accordingly, in the embodiment of the present disclosure, the scan driver 130 operates on the basis of the signals TE, GVST and GCLK in identical or similar conditions even when the driving frequency is changed and thus ON periods (operation start periods) and blank periods are maintained.

In addition, compensation of the data voltage Source is performed through optical compensation when the driving frequency is changed in the embodiment of the present disclosure. Accordingly, the embodiment of the present disclosure can eliminate or improve the phenomenon that a user recognizes scene change, luminance change and color change with the naked eye according to driving frequency change, realizing high picture quality.

Figure 13:
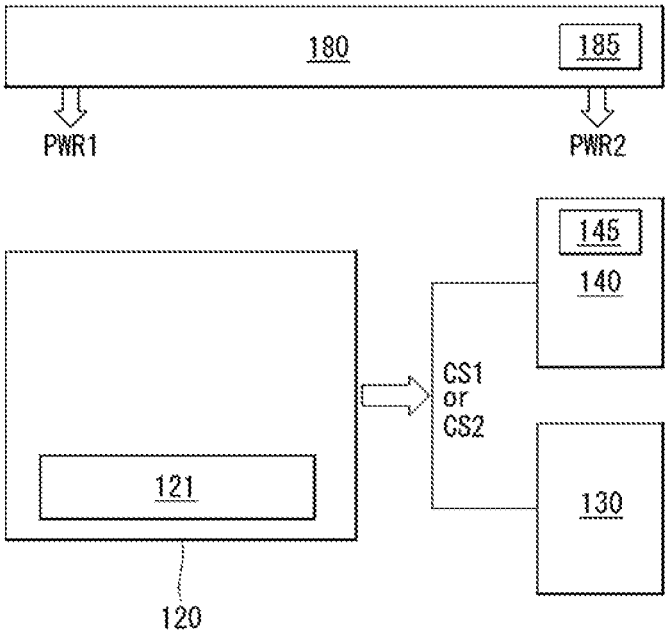
FIG. 13 is a diagram illustrating devices whose operating conditions are changed in response to a control signal generated from a device controller according to an embodiment of the present disclosure.
Figure 14:
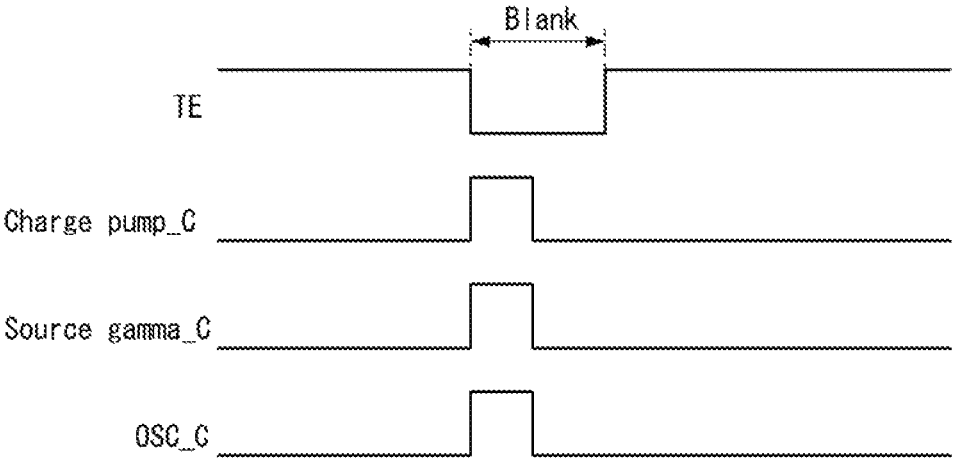
FIG. 14 is a waveform diagram for describing a period in which operating conditions of the devices shown in FIG. 13 are changed according to an embodiment of the present disclosure.

FIG. 13 is a diagram illustrating devices whose operating conditions are changed in response to a control signal generated from the device controller according to an embodiment of the present disclosure and FIG. 14 is a waveform diagram for describing a period in which operating conditions of the devices shown in FIG. 13 are changed.

As shown in FIG. 13, according to an embodiment of the present disclosure, the first control signal CS1 and the second control signal CS2 generated from the device controller can change operating conditions of the timing controller 120, the scan driver 130, the data driver 140 and the power supply 180.

The timing controller 120 includes an oscillator 121. The oscillator can generate a driving frequency according to a fixed frequency or variable frequency system. The first control signal CS1 and the second control signal CS2 include a first signal for controlling the driving frequency. Accordingly, the first control signal CS1 and the second control signal CS2 can be applied to the oscillator 121.

The oscillator 121 is a circuit included in the timing controller 120 and thus can receive the first set value or the second set value according to frequency selection instead of the first control signal CS1 and the second control signal CS2. However, when the oscillator 121 is positioned outside the timing controller 120, the oscillator 121 receives the first control signal CS1 and the second control signal CS2.

The data driver 140 includes a source gamma unit 145. The source gamma unit 145 can generate and provide a gamma voltage, for example, a gamma reference voltage, when a digital data signal is converted into an analog data voltage. The first control signal CS1 and the second control signal CS2 include a second signal for controlling a source gamma voltage. Accordingly, the first control signal CS1 and the second control signal CS2 can be applied to the source gamma unit 145.

For example, when the first control signal CS1 is applied, the source gamma unit 145 can perform a normal operation with a first gamma set. When the second control signal CS2 is applied, the source gamma unit 145 can perform an optical compensation operation with a second gamma set. The second gamma set is used in a higher frequency environment than that in which the first gamma set is used. Accordingly, the second gamma set can have gamma values for generating a higher gamma voltage level than the first gamma set for data voltage compensation according to a higher frequency environment.

The power supply 180 includes a charge pump circuit 185. The charge pump circuit 185 generates operating voltages PWR1 and PWR2 for operations of the timing controller 120, the scan driver 130 and the data driver 140 on the basis of power input from the outside. The first control signal CS1 and the second control signal CS2 include a third signal for controlling the operating voltages. Accordingly, the first control signal CS1 and the second control signal CS2 can be applied to the charge pump circuit 185.

As shown in FIGS. 13 and 14, the first signal OSC_C for controlling the oscillator 121, the second signal Source gamma_C for controlling the source gamma unit 145, and the third signal Charge pump_C for controlling the charge pump circuit 185 can be generated in response to a blank period "Blank" of the synchronization signal TE.

The blank period can correspond to a period in which an operation of displaying an image on the display panel is not performed and also correspond to a period in which frames are distinguished from each other. Accordingly, when the oscillator 121, the source gamma unit 145 and the charge pump circuit 185 are controlled within the blank period, the phenomenon that a user recognizes operating condition changes, for example, scene change, luminance change and color change, with the naked eye can be eliminated or improved. For example, when operating conditions of the devices are changed within the blank period, it is possible to improve display quality such as displaying smooth images while minimizing operating condition change.

Figure 15:
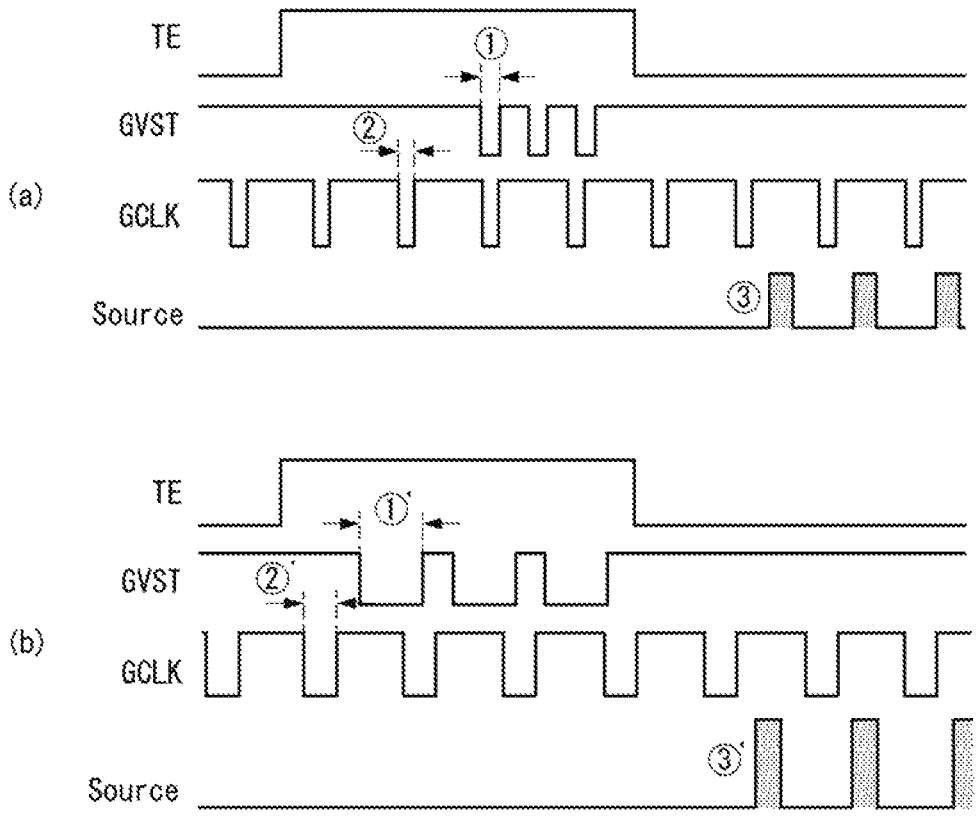
FIG. 15 is an operation waveform diagram for describing an operating condition difference between an experimental example and an embodiment of the present disclosure.

FIG. 15 is an operation waveform diagram for describing an operating condition difference between an experimental example and an embodiment. When the experimental example shown in FIG. 15 (*a*) is compared to the embodiment of the present disclosure shown in FIG. 15 (*b*), the experimental example differs from the embodiment of the present disclosure in that signal generation points change, and the widths of the first start signal GVST and the first clock signal GCLK decrease and optical compensation is not performed when the driving frequency is switched from 60 Hz to 90 Hz (refer to comparison between ①, ② and ③ in FIG. 15 (*a*) and ①', ②' and ③' in FIG. 15 (*b*)).

Figure 16:
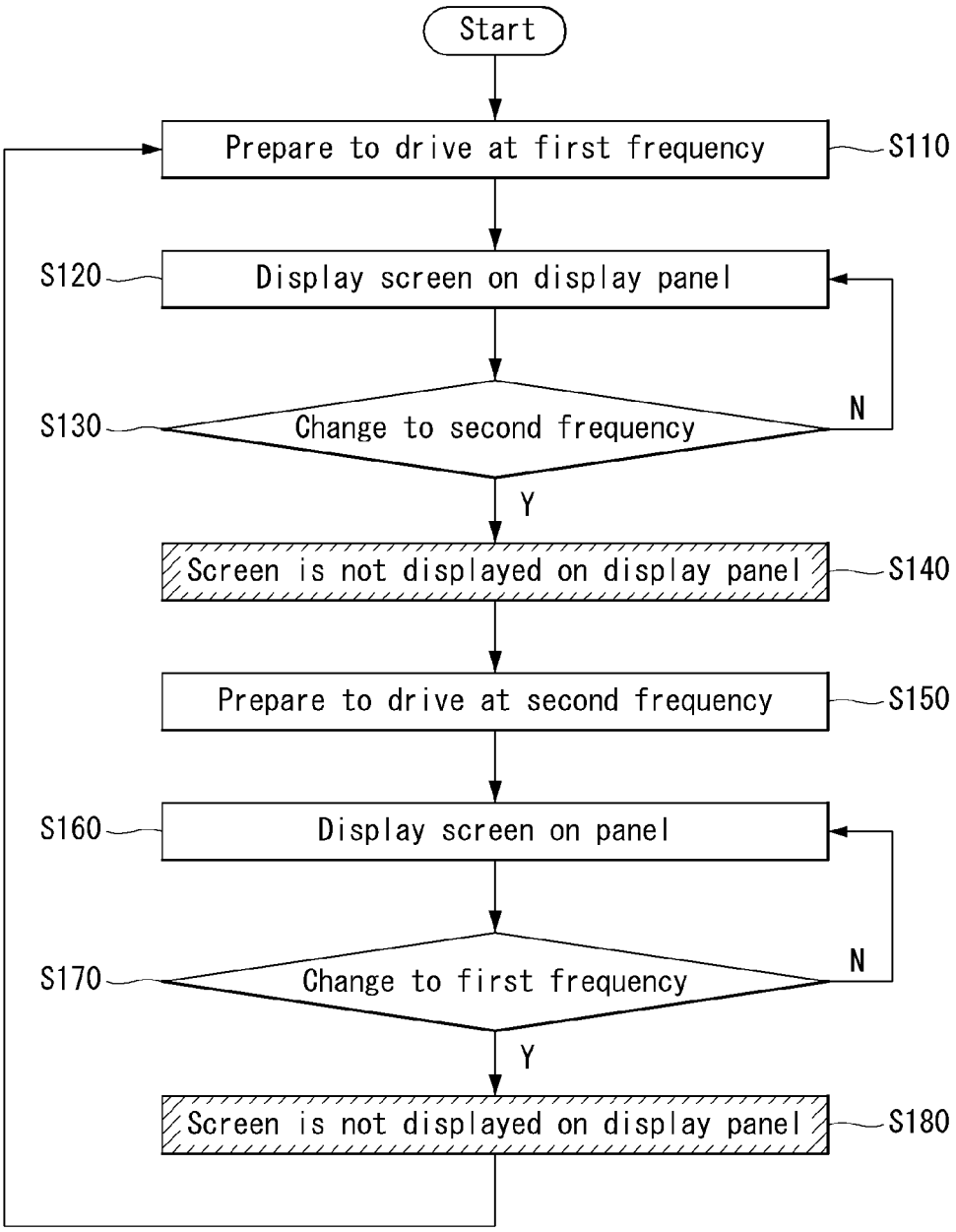
FIG. 16 is a flowchart for describing changes in devices according to driving frequency change in the experimental example.
Figure 17:
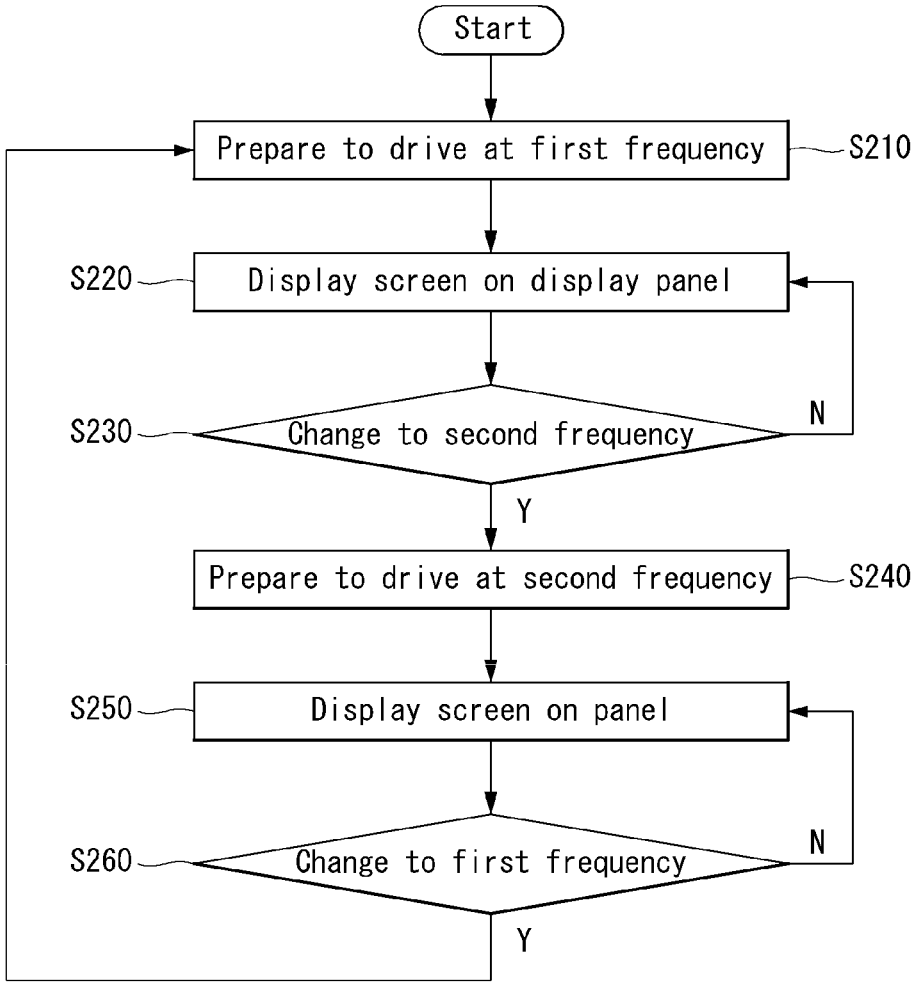
FIG. 17 is a flowchart for describing changes in devices according to driving frequency change in the embodiment of the present disclosure.

FIG. 16 is a flowchart for describing changes in devices according to driving frequency change in the experimental example and FIG. 17 is a flowchart for describing changes in devices according to driving frequency change in the embodiment of the present disclosure.

Hereinafter, changes in devices according to driving frequency change in the experimental example will be described with reference to FIG. 16.

First, operation to be performed at the first frequency is prepared (S110). When power is applied, a display apparatus of the experimental example sets a synchronization signal, a clock signal and a start signal for operation of the scan driver and a source gamma voltage for operation of the data driver in accordance with the first frequency and is ready to operate in the step of preparing operation at the first frequency.

Then, a screen is displayed on the display panel (S120). When the display apparatus of the experimental example has been ready to operate at the first frequency, the display apparatus displays a screen on the display panel. Here, the display panel operates at the first frequency to display images.

Subsequently, it is checked whether a signal instructing the frequency to be changed to the second frequency has been input (S130). When the signal instructing the frequency to be changed to the second frequency has not been input (N), the display panel continuously operates at the first frequency to display images. However, when the signal instructing the frequency to be changed to the second frequency has been input (Y), the display panel does not display images (S140). That is, the display panel has a display off period corresponding to a non-display state.

Thereafter, operation to be performed at the second frequency is prepared (S150). The display apparatus of the experimental example produces a synchronization signal, a clock signal and a start signal for operation of the scan driver, sets the signals to be suited to the second frequency and is ready to operate in the step of preparing operation at the second frequency. Here, source gamma voltage for operation of the data driver is not changed. That is, the data driver operates with the same source gamma voltage as previous one.

Then, a screen image is displayed on the display panel (S160). When the display apparatus of the experimental example has been ready to operate at the second frequency, the display apparatus displays a screen on the display panel. Here, the display apparatus of the experimental example displays images while only some devices such as the timing controller and the scan driver operate at the second frequency.

Subsequently, it is checked whether a signal instructing the frequency to be changed to the first frequency has been input (S170). When the signal instructing the frequency to be changed to the first frequency has not been input (N), the display panel continuously operates at the second frequency to display images. However, when the signal instructing the frequency to be changed to the first frequency has been input (Y), the display panel does not display images (S180). That is, the display panel has a display off period corresponding to a non-display state.

Then, operation to be performed at the first frequency is prepared (S110), and the display panel displays a screen when the display apparatus has been ready to operate at the first frequency (S120).

As can be ascertained through the above description, the experimental example has a display off period in which a screen of the display panel is not displayed whenever the frequency change signal for changing frequencies is input. Accordingly, the experimental example brings about a problem that scene change and luminance change are recognized when the driving frequency is changed. In addition, a source gamma voltage for operation of the data driver is not changed even when the driving frequency is changed in the experimental example. Accordingly, the experimental example brings about a problem that color coordinate change and luminance change are recognized when the driving frequency is changed.

Hereinafter, changes in devices according to driving frequency change in the embodiment of the present disclosure will be described with reference to FIG. 17.

First, operation to be performed at the first frequency is prepared (S210). When power is applied, the display apparatus according to the embodiment of the present disclosure sets a synchronization signal, a clock signal and a start signal for operation of the scan driver and a source gamma voltage for operation of the data driver in accordance with the first frequency and is ready to operate in the step of preparing operation at the first frequency.

Then, a screen is displayed on the display panel (S220). When the display apparatus according to the embodiment of the present disclosure has been ready to operate at the first frequency, the display apparatus displays a screen on the display panel. Here, the display panel operates at the first frequency to display images.

Subsequently, it is checked whether a signal instructing the frequency to be changed to the second frequency has been input (S230). When the signal instructing the frequency to be changed to the second frequency has not been input (N), the display panel continuously operates at the first frequency to display images.

When the signal instructing the frequency to be changed to the second frequency has been input (Y), operation to be performed at the second frequency is prepared (S240). The display apparatus according to the embodiment of the present disclosure resets the synchronization signal, the clock signal and the start signal for operation of the scan driver and the source gamma voltage for operation of the data driver in accordance with the second frequency and is ready to operate in the step of preparing operation at the second frequency.

Then, a screen is displayed on the display panel (S250). When the display apparatus of the embodiment of the present disclosure has been ready to operate at the second frequency, the display apparatus displays a screen on the display panel. Here, the display apparatus of the embodiment of the present disclosure displays images while devices including the timing controller, the scan driver, the data driver and the power supply operate at the second frequency, in this situation, the data driver can compensate for and output data voltages on the basis of a higher gamma voltage than that during operation at the first frequency.

Subsequently, it is checked whether a signal instructing the frequency to be changed to the first frequency has been input (S260). When the signal instructing the frequency to be changed to the first frequency has not been input (N), the display panel continuously operates at the second frequency to display images. However, when the signal instructing the frequency to be changed to the first frequency has been input (Y), operation to be performed at the first frequency is prepared (S210), and a screen is displayed on the display panel when the display apparatus has been ready to operate at the first frequency (S220).

As can be ascertained through the above description, the embodiment of the present disclosure does not have a display off period in which a screen of the display panel is not displayed even when the frequency change signal for changing frequencies is input because operating conditions of devices including the timing controller, the scan driver, the data driver and the power supply are changed to be suited to a changed driving frequency during a blank period when the frequency change signal is input. Accordingly, the embodiment of the present disclosure can solve or improve the problem that scene change and luminance change are recognized when the driving frequency is changed. In addition, source gamma voltage for operation of the data driver can be compensated in response to driving frequency change in the embodiment of the present disclosure. Accordingly, the embodiment of the present disclosure can solve or improve the problem that color coordinate change and luminance change are recognized even when the driving frequency is changed.

Figure 18:
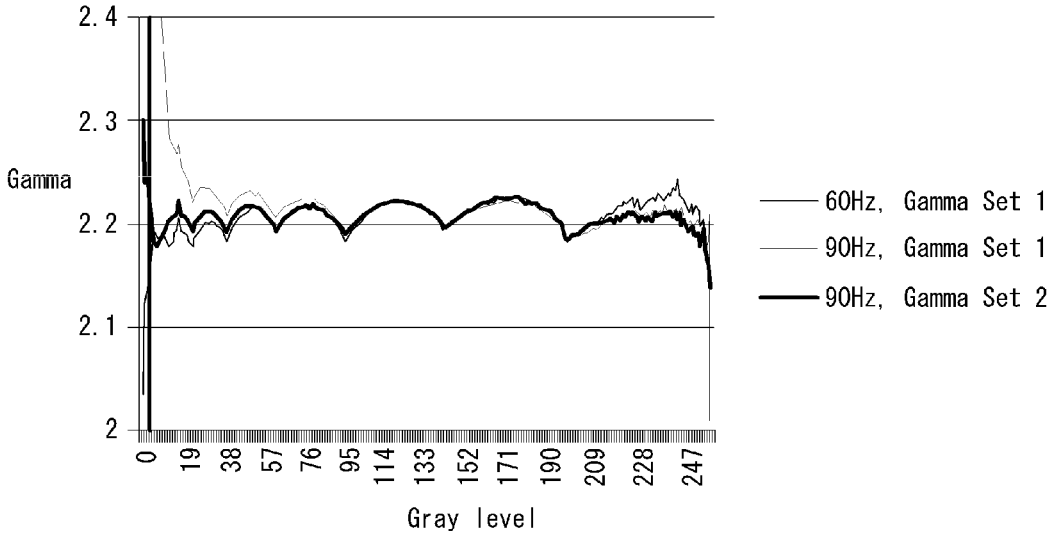
FIG. 18 is a diagram showing measurement data for checking variations in a gamma curve when a driving frequency is changed from 60 Hz to 90 Hz according to an embodiment of the present disclosure.

FIG. 18 is a diagram showing measurement data for checking variations in a gamma curve when a driving frequency is changed from 60 Hz to 90 Hz. The horizontal axis represents a gray level and the vertical axis represents gamma value. It can be ascertained through FIG. 18 that the gamma curve is generated to be closer to gamma value 2.2 according to gray level when a second gamma set (90 Hz) according to the embodiment is applied than in the situation of a first gamma set (90 Hz) according to the experimental example when the driving frequency is changed from 60 Hz to 90 Hz.

Figure 19:
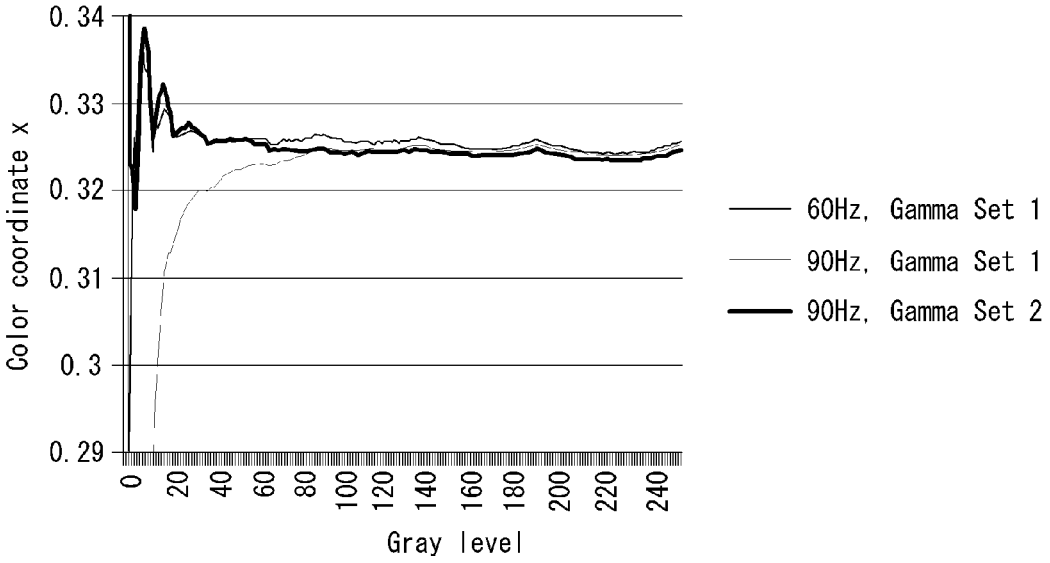
FIG. 19 is a diagram showing measurement data for checking variations in a color coordinate x when a driving frequency is changed from 60 Hz to 90 Hz according to an embodiment of the present disclosure.

FIG. 19 is a diagram showing measurement data for checking variations in color coordinate x when the driving frequency is changed from 60 Hz to 90 Hz. The horizontal axis represents a gray level and the vertical axis represents color coordinate x. It can be ascertained through FIG. 19 that the color coordinate x less changes according to gray level when the second gamma set (90 Hz) according to the embodiment is applied than in the situation of the first gamma set (90 Hz) according to the experimental example when the driving frequency is changed from 60 Hz to 90 Hz.

Figure 20:
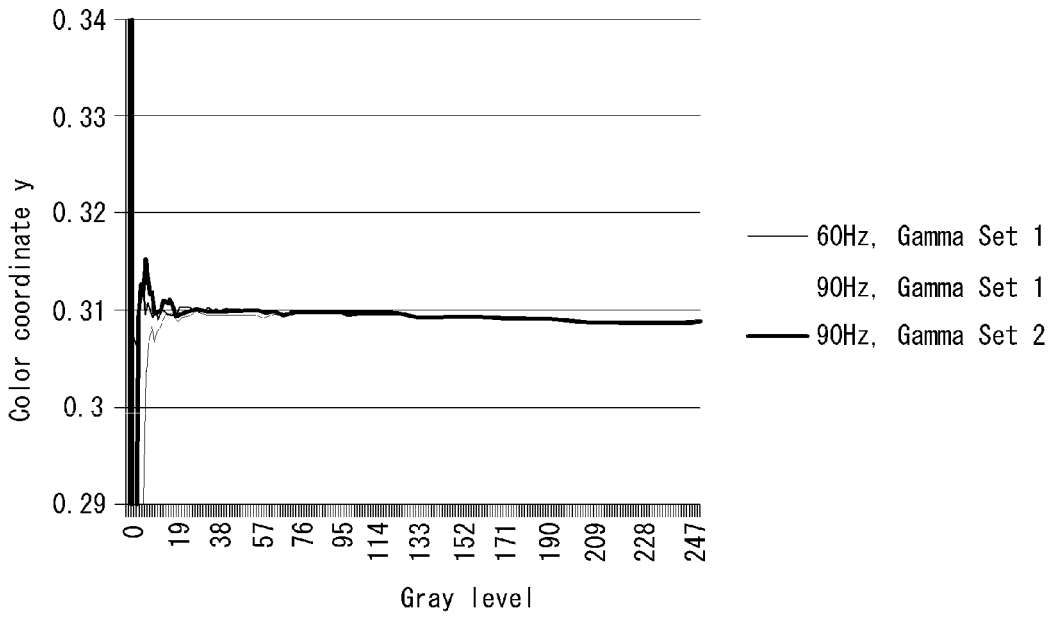
FIG. 20 is a diagram showing measurement data for checking variations in a color coordinate y when a driving frequency is changed from 60 Hz to 90 Hz according to an embodiment of the present disclosure.

FIG. 20 is a diagram showing measurement data for checking variations in color coordinate y when the driving frequency is changed from 60 Hz to 90 Hz. The horizontal axis represents a gray level and the vertical axis represents color coordinate y. It can be ascertained through FIG. 20 that the color coordinate y less changes according to gray level when the second gamma set (90 Hz) according to the embodiment is applied than in the situation of the first gamma set (90 Hz) according to the experimental example when the driving frequency is changed from 60 Hz to 90 Hz.

Figure 21:
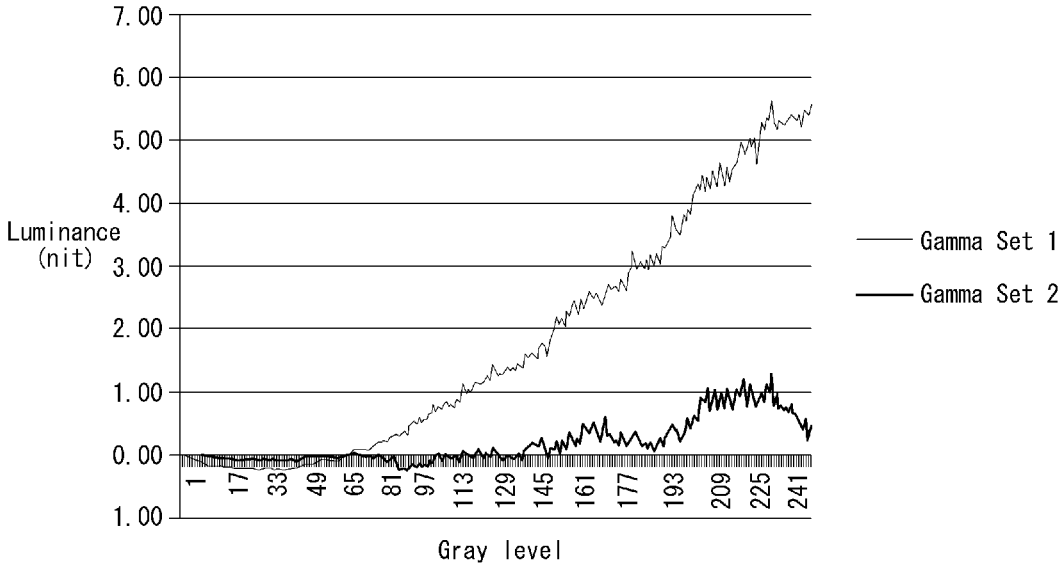
FIG. 21 is a diagram showing measurement data for checking variations in luminance when a driving frequency is changed from 60 Hz to 90 Hz according to an embodiment of the present disclosure.

FIG. 21 is a diagram showing measurement data for checking luminance variation when the driving frequency is changed from 60 Hz to 90 Hz. The horizontal axis represents a gray level and the vertical axis represents luminance (nit). It can be ascertained through FIG. 21 that luminance variation for each gray level is insignificant when the second gamma set (90 Hz) according to the embodiment is applied, compared to the first gamma set (90 Hz) according to the experimental example, when the driving frequency is changed from 60 Hz to 90 Hz.

Accordingly, as can be ascertained through FIGS. 18 to 21, luminance and color coordinates similar to those corresponding to a driving frequency of 60 Hz can be obtained even when the driving frequency is changed from 60 Hz to 90 Hz in the embodiment of the present disclosure. FIGS. 18 to 21 show the first frequency having a driving frequency of 60 Hz and the second frequency having a driving frequency of 90 Hz as an example. Embodiments of the present disclosure are not limited thereto and can also be applied when operating conditions are changed to frequencies higher or lower than a normal driving frequency, such as 50 Hz↔60 Hz, 60 Hz↔120 Hz, 90 Hz↔120 Hz, and 1 Hz↔60 Hz.

A display apparatus according to an embodiment of the present disclosure includes a display panel which displays images, a scan driver which provides scan signals to the display panel, a data driver which provides data voltages to the display panel, a timing controller which controls the scan driver and the data driver, and a device controller which changes a driving frequency of a device including the scan driver and the data driver to a first frequency or a second frequency higher than the first frequency in response to a frequency change signal, and the device controller maintains the widths of driving signals of the scan driver before and after the driving frequency of the device is changed.

According to some embodiments of the present disclosure, the driving signals of the scan driver can include a vertical synchronization signal, a start signal and a clock signal.

According to some embodiments of the present disclosure, when the driving frequency is changed to the second frequency higher than the first frequency, the data driver can compensate for and output data voltages on the basis of a higher gamma voltage than that during operation at the first frequency.

According to some embodiments of the present disclosure, the data driver can include a source gamma unit which generates gamma voltages, and the source gamma unit can perform a normal operation with a first gamma set corresponding to the first frequency and perform a compensation operation with a second gamma set corresponding to the second frequency.

According to some embodiments of the present disclosure, the second gamma set can have gamma values for generating gamma voltage levels higher than the first gamma set.

According to some embodiments of the present disclosure, the device controller can retrieve a first set value corresponding to the first frequency or a second set value corresponding to the second frequency from a memory when the frequency change signal is applied and change the driving frequency of the timing controller, the data driver and the scan driver in response to the first set value or the second set value.

According to some embodiments of the present disclosure, the device controller can control at least one of an oscillator which generates frequencies in the timing controller, a source gamma unit which generates gamma voltages in the data driver, and a charge pump circuit which generates driving voltages in a power supply in response to the driving frequency change.

According to some embodiments of the present disclosure, the device controller can control at least one the oscillator, the source gamma unit and the charge pump circuit during a blank period in which an image is displayed on the display panel.

A display apparatus according to an embodiment of the present disclosure includes a display panel which displays images, and a device controller which changes a driving frequency of a device to a first frequency or a second frequency higher than the first frequency in response to a frequency change signal, and the device controller maintains the widths of a vertical synchronization signal, a start signal and a clock signal for operation of the device before and after the driving frequency of the device is changed.

According to some embodiments of the present disclosure, when the driving frequency is changed to the second frequency higher than the first frequency, a data voltage applied to the display panel can be compensated on the basis of a higher gamma voltage than that during operation at the first frequency.

A display apparatus according to an embodiment of the present disclosure includes a display panel which displays images, and a device controller which changes a driving frequency of a device to a first frequency or a second frequency higher than the first frequency in response to a frequency change signal, wherein a data voltage applied to the display panel is compensated on the basis of a higher gamma voltage than that during operation at the first frequency when the driving frequency is changed to the second frequency higher than the first frequency.

According to some embodiments of the present disclosure, the device controller can maintain the widths of driving signals for operation of the device before and after the driving frequency of the device is changed.

A display apparatus according to an embodiment of the present disclosure includes a display panel which displays images, and a device controller which changes a driving frequency of a device to a first frequency or a second frequency higher than the first frequency in response to a frequency change signal, wherein the display panel does not have a display off period in which a screen is not displayed when the driving frequency is changed from the first frequency to the second frequency or changed from the second frequency to the first frequency.

According to some embodiments of the present disclosure, the widths of a vertical synchronization signal, a start signal and a clock signal for operation of the device can be maintained, whereas a data voltage applied to the display panel can be compensated on the basis of a higher gamma voltage than that during operation at the first frequency when the driving frequency of the device is changed to the second frequency.

A method of driving a display apparatus according to an embodiment of the present disclosure includes: driving a device at a first frequency and displaying a screen on a display panel; checking whether a signal instructing the first frequency to be changed to a second frequency higher than the first frequency is input; and driving the device at the second frequency and displaying a screen on the display panel when the signal instructing the first frequency to be changed to the second frequency is input, wherein the display panel does not have a display off period in which a screen is not displayed when a driving frequency is changed from the first frequency to the second frequency or changed from the second frequency to the first frequency.

According to some embodiments of the present disclosure, the widths of a vertical synchronization signal, a start signal and a clock signal for operation of the display panel can be maintained when the driving frequency is changed from the first frequency to the second frequency.

According to some embodiments of the present disclosure, a data voltage applied to the display panel can be compensated on the basis of a higher gamma voltage than that during operation at the first frequency when the driving frequency is changed from the first frequency to the second frequency.

As described above, the present disclosure can eliminate or improve the phenomenon that a user recognizes scene change, luminance change and color difference change with the naked eye according to driving frequency change, realizing high picture quality. In addition, the present disclosure can change operating conditions of almost all devices during a blank period in response to driving frequency change, and thus smooth scene change without flicking can be achieved.

What is claimed is:

1. A display apparatus, comprising:

a display panel configured to display images;

a scan driver configured to supply scan signals to the display panel;

a data driver configured to supply data voltages to the display panel; and a timing controller configured to:

control the scan driver and the data driver, in response to receiving a frequency change signal, change a driving frequency of a device from a first frequency to a second frequency higher than the first frequency or change the driving frequency of the device from the second frequency to the first frequency, while maintaining widths of driving signals of the scan driver before and after the driving frequency is changed, and in response to the driving frequency being changed, adjust at least one of an oscillator generating frequencies in the timing controller, and a charge pump circuit generating driving voltages in a power supply, wherein the device includes at least one of the scan driver or the data driver.

2. The display apparatus of claim 1, wherein the driving signals of the scan driver include a vertical synchronization signal, a start signal and a clock signal.

3. The display apparatus of claim 1, wherein the data driver is further configured to:

in response to the driving frequency being changed from the first frequency to the second frequency, output compensated data voltages based on higher gamma voltages than gamma voltages output by the data driver during operation at the first frequency.

4. The display apparatus of claim 1, wherein the data driver includes a source gamma unit configured to generate gamma voltages, and wherein the source gamma unit is configured to:

perform a normal operation with a first gamma set corresponding to the first frequency, and perform a compensation operation with a second gamma set corresponding to the second frequency, the second gamma set being different than the first gamma set.

5. The display apparatus of claim 4, wherein the second gamma set has gamma values for generating higher gamma voltage levels than the first gamma set.

6. The display apparatus of claim 1, wherein the timing controller is further configured to:

retrieve a first set value corresponding to the first frequency or a second set value corresponding to the second frequency from a memory when the frequency change signal is applied, and change the driving frequency of the timing controller, the data driver and the scan driver based on to the first set value or the second set value.

7. The display apparatus of claim 1, wherein the timing controller is further configured to:

in response to the driving frequency being changed, adjust a source gamma unit generating gamma voltages in the data driver.

8. The display apparatus of claim 7, wherein the timing controller adjusts the at least one of the oscillator, and the charge pump circuit during a blank period in which an image is not displayed by the display panel.

9. The display apparatus of claim 1, wherein the timing controller includes an input signal analysis unit and a control signal output unit, wherein the input signal analysis unit is configured to:

analyze the frequency change signal, supply a first set value corresponding to the first frequency or a second set value corresponding to the second frequency according to an analysis result of analyzing the frequency change signal, and transmit the first set value or the second set value to the control signal output unit, wherein the control signal output unit is configured to:

output a first control signal in response to the first set value transmitted from the input signal analysis unit or output a second control signal in response to the second set value transmitted from the input signal analysis unit, and wherein an operating condition of the device including the scan driver and the data driver is changed according to the first control signal and the second control signal output from the control signal output unit.

10. The display apparatus of claim 9, wherein the operating condition is changed according to the first control signal and the second control signal output from the control signal output unit during a blank period in which an image is not displayed by the display panel.

11. The display apparatus of claim 1, wherein the timing controller is further configured to:

transition the device from using the first driving frequency to using the second driving frequency while the display panel continues to display images without any display off period in which a screen is not displayed by the display panel, and transition the device from using the second driving frequency to using the first driving frequency while the display panel continues to display images without any display off period in which a screen is not displayed by the display panel.

12. A display apparatus comprising:

a display panel configured to display images; and a timing controller configured to:

in response to receiving a frequency change signal, change a driving frequency of a device of the display apparatus from a first frequency to a second frequency higher than the first frequency or change the driving frequency of the device from the second frequency to the first frequency, while maintaining widths of a vertical synchronization signal, a start signal and a clock signal for operation of the device before and after the driving frequency is changed, and in response to the driving frequency being changed, adjust at least one of an oscillator generating frequencies in the timing controller and a charge pump circuit generating driving voltages in a power supply.

13. The display apparatus of claim 12, wherein the timing controller is further configured to:

in response to the driving frequency transitioning from the first frequency to the second frequency, supply compensated data voltages to the display panel, the compensated data voltages being based on higher gamma voltages than gamma voltages supplied during operation at the first frequency.

14. A display apparatus comprising:

a display panel displaying images; and a timing controller configured to:

in response to receiving a frequency change signal, change a driving frequency of a device of the display apparatus from a first frequency to a second frequency higher than the first frequency or change the driving frequency of the device from the second frequency to the first frequency, and compensate a data voltage supplied to the display panel based on a higher gamma voltage than a gamma voltage supplied during operation at the first frequency, and in response to the driving frequency being changed, adjust at least one of an oscillator generating frequencies in the timing controller, and a charge pump circuit generating driving voltages in a power supply.

15. The display apparatus of claim 14, wherein the timing controller is further configured to:

maintain widths of driving signals for operation of the device before and after the driving frequency of the device is changed.

16. A display apparatus comprising:

a display panel displaying images; and a timing controller configured to:

in response to receiving a frequency change signal, change a driving frequency of a device of the display apparatus from a first frequency to a second frequency higher than the first frequency or change the driving frequency of the device from the second frequency to the first frequency, while the display panel continues to display images without any display off period in which a screen is not displayed by the display panel, and in response to the driving frequency being changed, adjust at least one of an oscillator generating frequencies in the timing controller, and a charge pump circuit generating driving voltages in a power supply.

17. The display apparatus of claim 16, wherein the timing controller is further configured to:

maintain widths of a vertical synchronization signal, a start signal and a clock signal for operation of the device when the driving frequency transitions from the first frequency to the second frequency or from the second frequency to the first frequency, and in response to the driving frequency of the device being changed from the first frequency to the second frequency, supply a compensated data voltage to the display panel based on a higher gamma voltage than a gamma voltage supplied during operation at the first frequency.

18. A method of driving a display apparatus, the method comprising:

driving a device included in the display apparatus at a first frequency while displaying a screen on a display panel of the display apparatus;

receiving a frequency change signal changing a driving frequency of the device from the first frequency to a second frequency higher than the first frequency;

driving the device at the second frequency while continuing to display the screen on the display panel based on the frequency change signal without any display off period in which the screen is not displayed by the display panel as the driving frequency transitions from the first frequency to the second frequency; and adjusting at least one of an oscillator generating frequencies in a timing controller, and a charge pump circuit generating driving voltages in a Dower supply in response to the driving frequency being changed, wherein the device includes at least one of the scan driver or the data driver.

19. The method of claim 18, wherein widths of a vertical synchronization signal, a start signal and a clock signal for operation of the display panel are maintained when the driving frequency is changed from the first frequency to the second frequency.

20. The method of claim 18, wherein compensated data voltages are supplied to the display panel based on higher gamma voltages than gamma voltages supplied during operation at the first frequency when the driving frequency is changed from the first frequency to the second frequency.

21. The method of claim 18, wherein an operating condition of the device is changed during a blank period in which an image is not displayed by the display panel.

* * * * *